US008713733B2

(12) United States Patent
Caforio

(10) Patent No.: US 8,713,733 B2
(45) Date of Patent: May 6, 2014

(54) POSTURAL SYSTEM

(75) Inventor: Rosaria Eugenia Caforio, Mesagne (IT)

(73) Assignee: Pro Medicare S.R.L., Mesagne (IT)

( * ) Notice: Subject to any disclaimer, the term of this patent is extended or adjusted under 35 U.S.C. 154(b) by 29 days.

(21) Appl. No.: 13/388,727

(22) PCT Filed: May 25, 2011

(86) PCT No.: PCT/IB2011/052282
§ 371 (c)(1),
(2), (4) Date: Feb. 3, 2012

(87) PCT Pub. No.: WO2011/148329
PCT Pub. Date: Dec. 1, 2011

(65) Prior Publication Data

US 2012/0137441 A1 Jun. 7, 2012

(30) Foreign Application Priority Data

May 26, 2010 (IT) ..... TO2010A0442

(51) Int. Cl.
*A47C 4/54* (2006.01)

(52) U.S. Cl.
USPC ..... 5/648; 5/640; 5/632; 5/722; 5/723; 5/657

(58) Field of Classification Search
USPC ..... 5/630, 632, 640, 648, 691, 705, 722, 5/723, 652, 657
See application file for complete search history.

(56) References Cited

U.S. PATENT DOCUMENTS 3,279,849 A * 10/1966 Radke et al. ..... 297/284.5
3,877,093 A * 4/1975 Gershbein ..... 5/723
4,718,727 A 1/1988 Sheppard
5,018,790 A * 5/1991 Jay ..... 297/452.26
5,149,173 A * 9/1992 Jay et al. ..... 297/284.9
5,333,921 A 8/1994 Dinsmoor, III
5,343,876 A 9/1994 Rogers (Continued)

FOREIGN PATENT DOCUMENTS

GB 2 102 283 A 2/1983
WO WO 95/33396 A1 12/1995

OTHER PUBLICATIONS

International Search Report for PCT/IB2011/052282 dated Sep. 26, 2011.

(Continued)

*Primary Examiner* — William Kelleher
(74) *Attorney, Agent, or Firm* — Sughrue Mion, PLLC

(57) ABSTRACT

This invention relates to a postural system which can advantageously be used by both properly walking persons and non-ambulant and partially ambulant persons, and in the latter case is suitable for use with or incorporation with medical support devices for mobility, medical devices for rehabilitation and social or domestic life and the like: this system may also be advantageously used with or incorporated with transport means. The postural system according to the invention provides a supporting structure comprising a flat base plate (10) and a plurality of modular blocks (20*a*-20*f*, 30*a*-30*d*, 40*a*-40*f*, 50*a*-50*e*, 80*a*-80*b*) intended to support various segments of the user's body (legs, pelvis, spine and so on). The number, shape, size and orientation of the said modular blocks can be suitably selected to obtain a perfect fit for the user's shape (whether male or female) and encourage perfect housing of the body and a correct weight distribution over the entire surface of the seat.

18 Claims, 6 Drawing Sheets

(56) References Cited

U.S. PATENT DOCUMENTS

| | | | | |
|---|---|---|---|---|
| 5,448,790 | A * | 9/1995 | Saro et al. | 5/657 |
| 5,524,640 | A * | 6/1996 | Lisak et al. | 5/655 |
| 5,820,573 | A * | 10/1998 | Ramos | 601/134 |
| 6,047,420 | A * | 4/2000 | Priester et al. | 5/632 |
| 6,817,664 | B1 * | 11/2004 | Tang et al. | 297/229 |
| 6,921,372 | B2 * | 7/2005 | Shin | 601/134 |
| 7,093,898 | B2 * | 8/2006 | Ladron De Guevara | 297/284.6 |
| 7,757,321 | B2 * | 7/2010 | Calvert | 5/657 |
| 2009/0217458 | A1 * | 9/2009 | Lord | 5/655 |
| 2010/0058540 | A1 | 3/2010 | Calvert | |

OTHER PUBLICATIONS

International Preliminary Report on Patentability for PCT/IB2011/052282, dated Sep. 4, 2012.

* cited by examiner

POSTURAL SYSTEM

TECHNICAL FIELD OF THE INVENTION

This invention relates to a postural system.

In particular the postural system according to the invention may be used by non-ambulant or partly-ambulant persons and is designed to be fitted on or be an integral part of medical support devices for mobility, such as manual and/or electronic carriages, medical devices for rehabilitation and social or domestic life, such as bases with or without wheels for institutional and/or school use.

However, the postural system according to the invention may advantageously also be used by people who are able to walk properly in combination with chairs, seats, benches and similar articles—as a separate and removable article or as an integral part thereof—to ensure correct posture in the sitting position. In particular it may also be advantageously used in transport means.

PRIOR ART

The sitting position is influenced by many factors, the first among which is the force of gravity. Other factors are to be found in the kinetic and kinematic system of the human body, and in the sensory and perceptive system which define posture as a dynamic and non-static posture.

In individuals who are capable of maintaining a sitting position by themselves self-control mechanisms which depend on the interaction of three sensory systems (perceptive system, processing system and actuator system) are involved and make it possible to react to external stimuli, even if the reaction may not always be perfectly correct and timely. The problem of maintaining correct posture arises even more keenly in the case of persons who are affected by diseases deriving from damage to the central nervous system, whether genetic or acquired, in that in these cases the self-control mechanisms are not always able to act.

Some diseases deriving from damage to the central nervous system also result in changes in body structure, such as for example asymmetry of the pelvis in the frontal, sagittal and transverse planes, which in turn give rise to asymmetries in the lower limbs and/or deformity of the spine, and consequently give rise to limitations in basic body functions such as respiration, swallowing, communication, and so on.

In persons affected by diseases of this type a correct sitting position can only be achieved through external support systems which contain different segments of the body.

In particular, from the biomechanical point of view the part of the body which is of primary interest for a balanced and functional sitting position is the pelvis. It is known from scientific studies that the orientation of the sacrum in space and the angle of the pelvis determine the load on the entire spine, and therefore between the intervertebral discs, causing problems to arise in the spine.

It is therefore essential that postural systems for persons affected by diseases of this kind ensure correct support and containment for the pelvis.

It is obvious that in order to obtain the said correct support and containment for the pelvis it is necessary to bear in mind the particular morphology of individual persons, in particular the special morphology of their pelvises.

For example, from an anatomical point of view, there are structural and dimensional differences in the pelvis between men and women, which although small in infancy become significant after the tenth year of age. More generally it is desirable that a postural system that is suitably shaped and sized on the basis of their specific anatomical conformation can be provided for individuals.

However, the construction of bespoke postural systems deliberately designed for individuals is impractical in that this would require a complex and costly production process, which would result in virtually inaccessible prices for the final product.

It must also be borne in mind that a person's morphology is not fixed and unchanging, but can undergo major changes, particularly during the age of growth, but also subsequently thereto.

Thus even a bespoke postural system would not be able to ensure correct support and containment of an individual's pelvis over the course of time. Modular systems which include accessories together with a basic postural system which can be removably associated with the aforesaid basic postural system so as to partly modify its shape are known from the state of the art.

Examples of such known postural systems can be found for example in documents U.S. Pat. No. 5,333,921 and WO 95/03396.

However, in postural systems of the type described in the above-mentioned documents the basic postural system has already in itself its own conformation shaped on the basis of a predetermined and unmodifiable model and removable accessories can only superficially change that shaped conformation.

As a consequence these known devices are unable to remedy the technical problem mentioned above, in that they cannot conform and dimension the postural system on the basis of the specific anatomical conformation of individuals.

Document GB 2,102,283 describes a support for physical and rehabilitation exercises, in particular for disabled children, this support having a modular structure.

However the modularity of the support described is designed not so much to adapt to users with different morphological characteristics, but for the performance of different types of physical and rehabilitation exercises. Thus the descriptive support does not resolve the technical problem of ensuring correct support and containment of the user's pelvis. In addition to this, although it has a modular structure, this support does not adopt a sufficient variety of sizes and conformations to adapt to the anatomical conformation of all individuals.

The object of this invention is therefore to overcome the disadvantages of the prior art, providing a postural system that can provide the user with correct support and can be personalised according to the user's morphological characteristics.

Another object of this invention is to provide a postural system which can be easily modified to adjust to the morphological variations which can occur in users over the course of time.

Another object of this invention is that of providing a postural system which can be produced through a simple and economical manufacturing process so that a final product can be supplied at competitive prices.

This and other objects of this invention will be accomplished through a postural system as claimed in the appended claims.

DISCLOSURE OF THE INVENTION

Because of the fact that the postural system according to the invention is of a wholly modular nature and provides a supporting structure comprising a flat base plate, preferably made of damping and anti-vibration material, and a plurality of shaped blocks, it is possible to achieve perfect adaptation to the user's shape and encourage perfect housing of the body and correct weight distribution over the entire surface area of the seat.

In particular, the base supporting the user's body is already itself of a modular structure, which can be modified according to requirements, in particular according to the user's shape.

In particular, the said blocks can be shaped through cutting, removal of material, pressing or similar processing. They are also provided with means for being removably and reversibly coupled to the said base plate and to one another.

Advantageously, according to the invention, the number, shape and arrangement of the said shaped blocks may be selected in such a way as to conform perfectly to the user's structural shape.

Again according to the invention, the number, shape and arrangement of the said shaped blocks can be easily modified in relation to changes which may affect the user's shape with the passage of time.

According to requirements, the supporting structure of the postural system according to the invention may permit the pelvis (at all lateral and posterior support points), the coccyx, the sacrum, the lumbar vertebrae, the thoracic vertebrae and the remainder of the user's spine to be correctly accommodated.

According to a preferred embodiment of the invention, the modular postural system provides a supporting structure comprising:

- a flat base plate;
- a first plurality of modular blocks to form a modular base;
- a second plurality of modular blocks to accommodate the user's legs;
- a third plurality of modular blocks to accommodate the user's pelvis; and, possibly
- a fourth plurality of modular blocks to accommodate the user's spine.

The postural system according to the invention also comprises a padding system capable of being placed on top of the abovementioned supporting structure.

Advantageously, according to the invention, the said padding system is also modular and comprises a plurality of variably combinable padded cushions.

The postural system according to the invention may also comprise accessory devices such as for example a device for accommodating and supporting the user's shoulders and head, the said accessory devices preferably in turn having a modular structure.

Advantageously, the postural system according to the invention may be provided in kit form comprising the aforesaid base plate and a large number of modular blocks of different shapes and sizes, in such a way that the blocks having the most appropriate shape and size in relation to the user's conformation and requirements can be selected and the blocks so selected can be assembled onto the said base plate.

BRIEF DESCRIPTION OF THE DRAWINGS

Further advantages and characteristics of this invention will be apparent from the following detailed description of some preferred embodiments of the invention provided by way of non-limiting examples with reference to the appended drawings in which.

FIGS. from 1*a* to 1*d* show successive configurations of the modular construction of the supporting structure of the postural system according to a first embodiment of the invention.

DETAILED DESCRIPTION OF SOME PREFERRED EMBODIMENTS OF THE INVENTION

FIGS. from 1*a* to 1*d* show successive configurations of the modular construction of a postural system according to the invention.

In general the said postural system provides a supporting structure having a modular structure and comprising a base plate and a plurality of shaped blocks through which the body can be perfectly accommodated with a correct weight distribution over the entire surface of the seat.

Figure 1A:
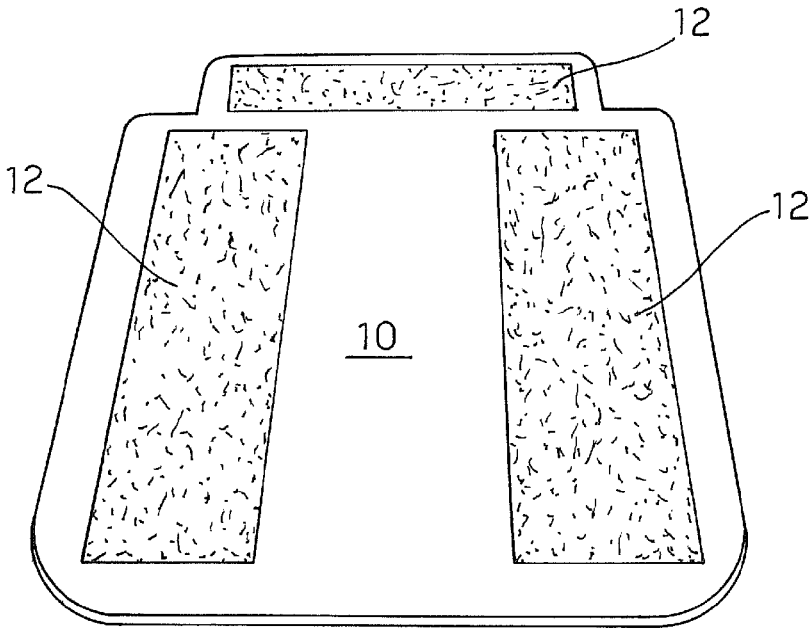

FIG. 1*a* illustrates the base plate 10 for the said postural system.

Said base plate 10 is a flat plate and can be manufactured from plastics, metal or composite material. During the stage of delivery to the final user the said plate may be easily modified, for example by cutting, in order to achieve the desired shape and size.

Said base plate 10 has a bottom surface provided with coupling means which can be used for coupling to a carriage having a base with or without wheels for institutional and/or school use or with a plate suitably designed to permit the coupling of possible accessories.

The said base plate also has a top surface provided with coupling means 12 for coupling to the said modular blocks.

Figure 1B:
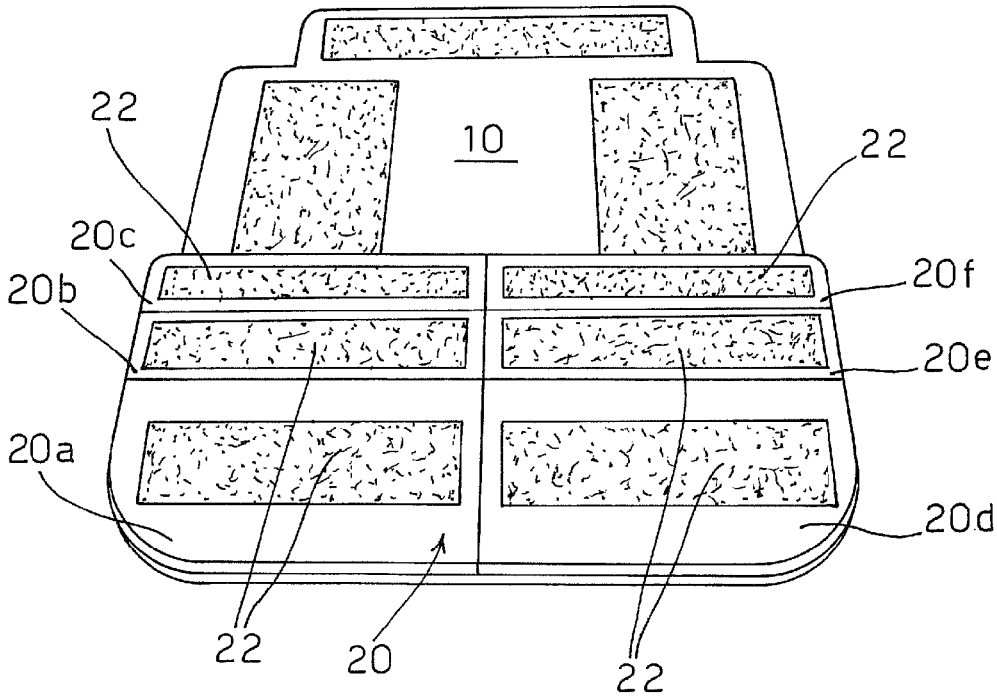

Said coupling means 12 may for example comprise coupling systems with binder blocking systems and/or male and/or female fastener tapes. In FIG. 1*b* a first plurality of modular blocks 20*a*-20*f* are coupled to base plate 10 to produce a modular base, generally indicated by reference 20.

Said modular base 20 has the function of preventing slipping of the hips, which also may be asymmetrical, and maintaining equilibrium of the legs/pelvis relationship system.

Modular blocks 20*a*-20*f* are made of plastics or composite material, are pre-shaped and can be adapted through cutting, removal of material or other similar processing.

Each of said modular blocks 20*a*-20*f* are provided on their bottom surfaces with coupling means for coupling to flat base plate 10. Each of these is also provided with coupling means 22 on its top surface for coupling to a further plurality of shaped blocks which are used to position and guide the legs individually, and will be described below.

Said coupling means 22 may for example comprise coupling systems with binder blocking systems and/or male and/or female fastener tapes. In the construction of modular base 20 the said modular blocks are placed in two rows, on the left and right respectively of base plate 10.

If the postural system is intended for a user having legs of different length, each of the said rows can be dimensioned according to the length of the corresponding leg by removing one or more of said blocks 20*a*-20*f* on either side, and then subsequently cutting base plate 10.

If the postural system is intended for a user having a pelvis which is rotated to the right or left in the frontal plane, each of the said rows may be positioned along the length of base plate 10 at different levels so that each of the two rows of blocks 20*a*-20*f* can provide an obstacle against slipping of the hips in a differential way.

If the postural system is intended for a user having bowed and/or dislocated legs, each of the said rows can be fixed to base plate 10 in an off-centre and/or oblique way with respect to the supporting plane thereof.

If the postural system is intended for a user with outwardly rotated legs, each of the said rows may be fixed to base plate 10 in a divaricated way with respect to the longitudinal median line of the base plate.

It is obvious that from what has been described above that modular base 20 may adopt different configurations to match the shape characteristics of the user and that these configurations may be modified in the course of use in relation to changes in the structure of the user's shape or other needs.

It is also obvious by merely using a modular structure of the type described above for modular base 20 the invention makes it possible to overcome the problems in the prior art and to accomplish the objects specified above.

In a variant of the embodiment illustrated, each of the two rows of modular blocks 20*a*-20*f* may be provided with a lower matchingly-shaped member, also having a modular structure, which will encourage anterior-posterior equilibrium of the pelvis.

Figure 1C:
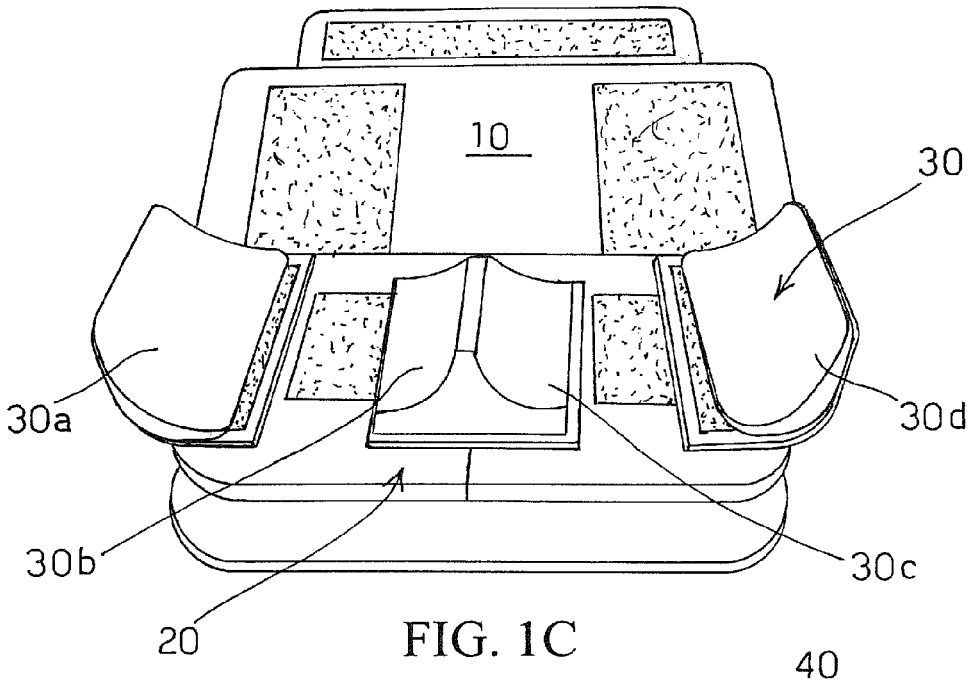

In FIG. 1*c* a second plurality of modular blocks 30*a*-30*d* is applied to modular base 20 to provide a modular system for accommodating the user's legs, generically indicated by reference 30.

Modular blocks 30*a*-30*d* are manufactured from plastics or composite material, are pre-shaped and can be adapted through cutting, removal of material or other similar processing.

Each of said modular blocks 30*a*-30*d* is provided with coupling means on its bottom surface for coupling to module base 20.

Said coupling means may for example comprise coupling systems using binder blocking systems and/or male and/or female fastener tapes.

Said blocks 30*a*-30*d* may be provided with wedges which are useful for increasing their thickness according to the user's dimensional needs, the said wedges being provided with coupling means on their top and bottom surfaces to permit coupling to modular base 20 and modular blocks 30*a*-30*d* for accommodating the legs respectively.

It is obvious that the modular nature of modular blocks 30*a*-30*d*, and of the corresponding wedges if provided, together with use of modular base 20, allows for the entire system for accommodation of the legs to be constructed in an extremely personalised and if necessary asymmetrical way.

In particular, according to the invention, the central abductor block which is used to keep the user's legs apart may comprise separate modular blocks 30*b*, 30*c*. By suitably selecting the shape and size of abductor blocks 30*b*, 30*c* it is possible to achieve the conformation which is most appropriate to the user's shape, even if asymmetrical, which is not possible with postural systems of the known type.

Figure 1D:
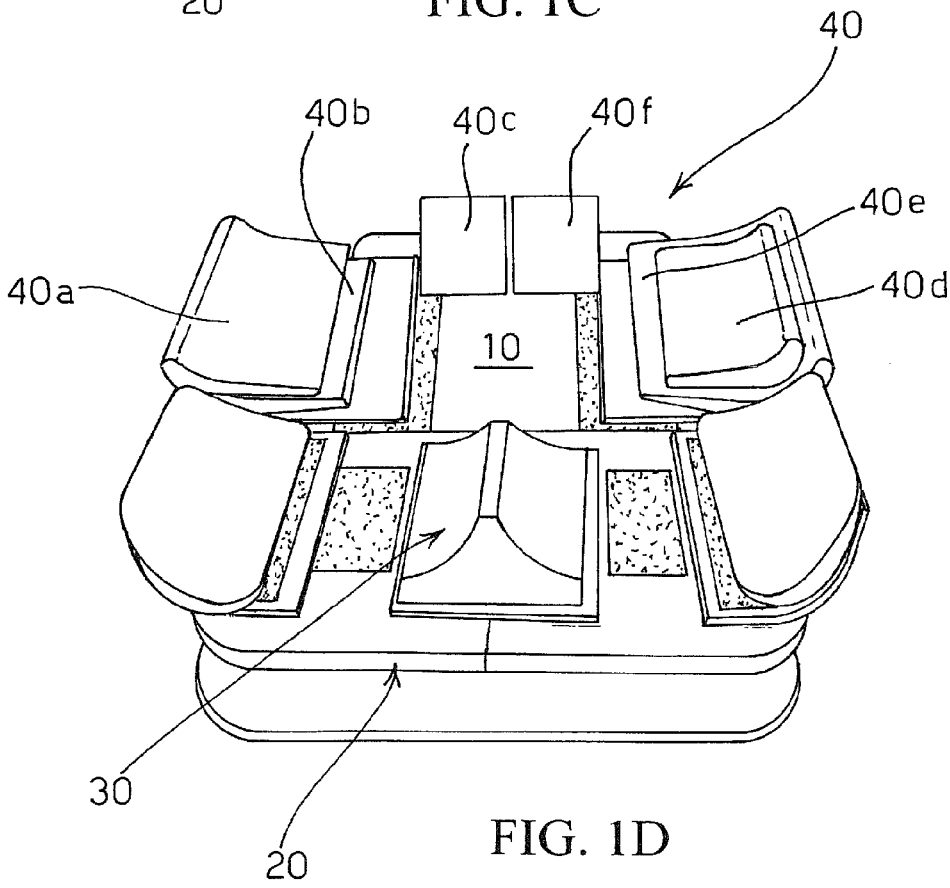

In FIG. 1*d*, a third plurality of modular blocks 40*a*-40*f* are fitted to the postural system according to the invention in order to produce a modular system for accommodating the user's pelvis, generically indicated by reference 40.

The said accommodation system may also be regarded as comprising a combination of containment, suspension and lateral and posterior control subsystems for the pelvis, and for the functional vertebral segments in the position of the same.

Modular blocks 40*a*-40*f* are made of plastics or composite material, are pre-shaped and may be adapted through cutting, removal of material or other similar processing.

Each of said modular blocks 40*a*-40*f* is provided with coupling means on its top and/or bottom surface for coupling to the posterior surface of flat base plate 10.

The said coupling means may for example comprise coupling systems having binder blocking systems and/or male and/or female fastener tapes.

As a result of the modular structure of pelvis accommodation system 40, achieved through independently coupling each of modular blocks 40*a*-40*f*, it is possible to achieve correct containment, suspension and anterior, lateral and posterior control of the user's pelvis, regardless of its morphological structure, and to adjust that containment to changes in body structure which might occur in the course of use.

The said pelvis accommodation system 40 also makes it possible to contain, support and control the functional vertebral segments directly influenced by the position of the pelvis, such as the coccyx, sacral vertebrae, lumbar vertebrae and thoracic vertebrae, thus achieving total support of the pelvic area (so-called "PTS—Pelvic Total Support").

Each of the aforesaid modular blocks 40*a*-40*f* may have different size, shape and arrangements depending upon the user's morphological structure, and may be fitted with useful accessories to alter their thickness, inclination or orientation, the said accessories being provided along the top and bottom surfaces with coupling means for respective coupling to flat base plate 10 and modular blocks 40*a*-40*f*.

Figure 2:
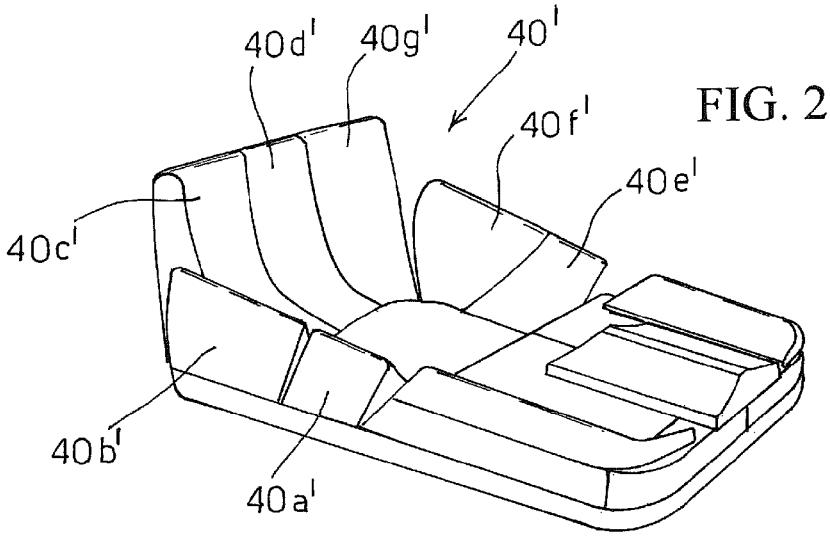
FIG. 2 shows a configuration similar to the configuration in FIG. 1*d* in a variant construction of the said first embodiment of the invention.

In this respect FIG. 2 illustrates a variant construction of the postural system according to the invention comprising a modular system for accommodating the pelvis 40' constructed by combining modular blocks 40*a*'-40*g*' in different ways and size.

Figure 3:
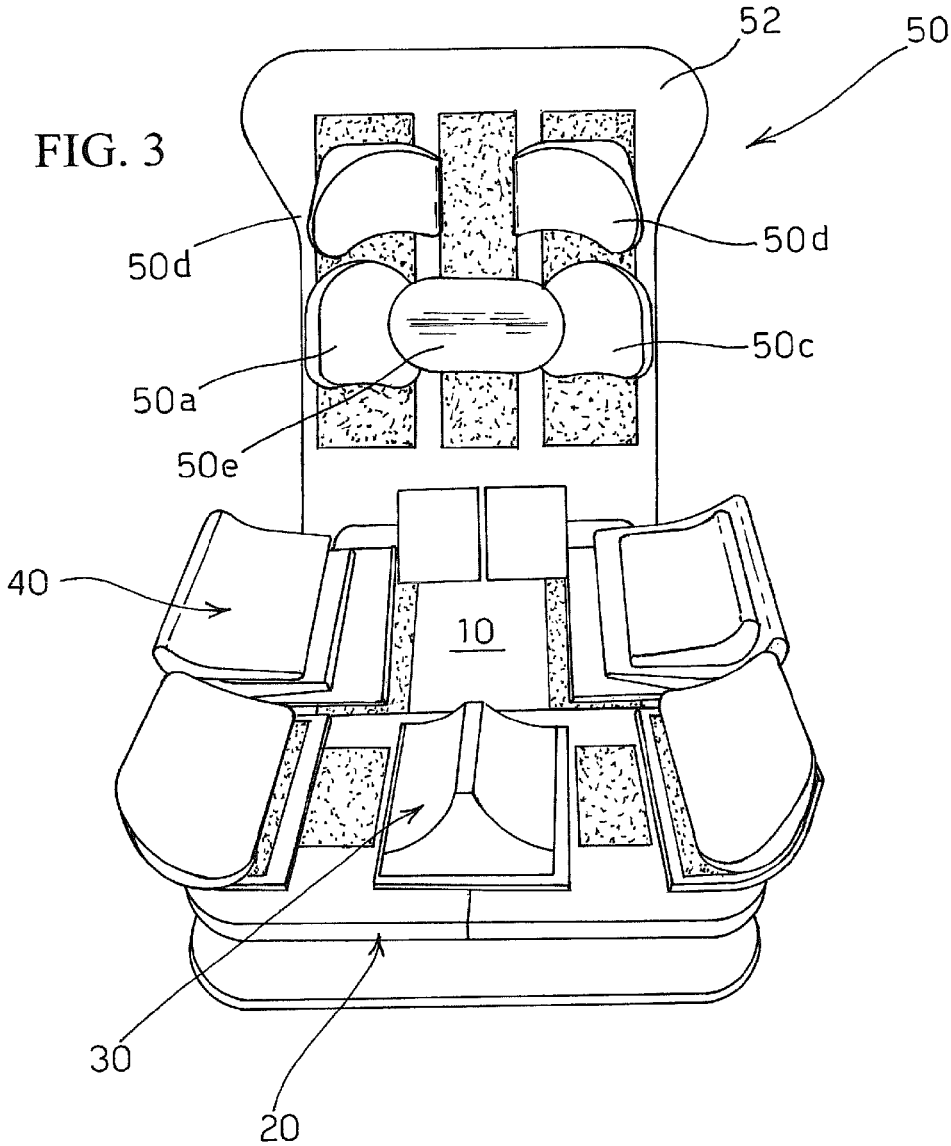
FIG. 3 shows a further configuration of the modular construction of the supporting structure of the postural system according to a second embodiment of the invention.

FIG. 3 illustrates the supporting structure of the postural system according to a second embodiment of the invention.

According to the embodiment in FIG. 3, a modular system for accommodating the user's back, generally indicated by reference 50, comprising a base back member 52 and a fourth plurality of modular blocks 50*a*-50*e*, is coupled to the supporting structure of the postural system according to the invention.

Flat base back member 52 may be constructed in the same way as base plate 10.

Modular blocks 50*a*-50*e* are made of plastics or composite material, are pre-shaped and can be adjusted through cutting, removal of material or other similar processing.

Each of modular blocks 50*a*-50*e* is provided with coupling means along the bottom surface to allow coupling along the lining of the supporting structure of the postural system and/or the flat base plate 10 of the said supporting structure.

The said coupling means may for example comprise coupling systems with binder blocking systems and/or male and/or female fastener tapes. The construction of the modular system 50 for accommodation of the spine using modular blocks 50*a*-50*e* makes it possible to achieve correct containment and anterior, lateral and posterior control of the user's trunk through independent coupling of each of the said blocks at different times according to the user's structural shape and correct accommodation of the spine and correlated segments and joints.

Each of modular blocks 50*a*-50*e* may be suitably designed with different sizes, shapes, heights and functions. In addition to this, each of the aforesaid blocks 50*a*-50*e* may be provided with accessories in order to alter their thickness, inclination or orientation according to the user's needs, the said accessories being provided with coupling means along their top and bottom surfaces for coupling respectively to the lining of the supporting structure or base plate 10 and modular blocks 50*a*-50*e*.

Said system 40 for accommodation of the spine also makes it possible to contain, support and control the lumbar and thoracic vertebrae and the remaining part of the spine, together with its correlated segments and joints, thus achieving total support of the trunk area (so-called "TTS—Trunk Total Support").

Figure 4:
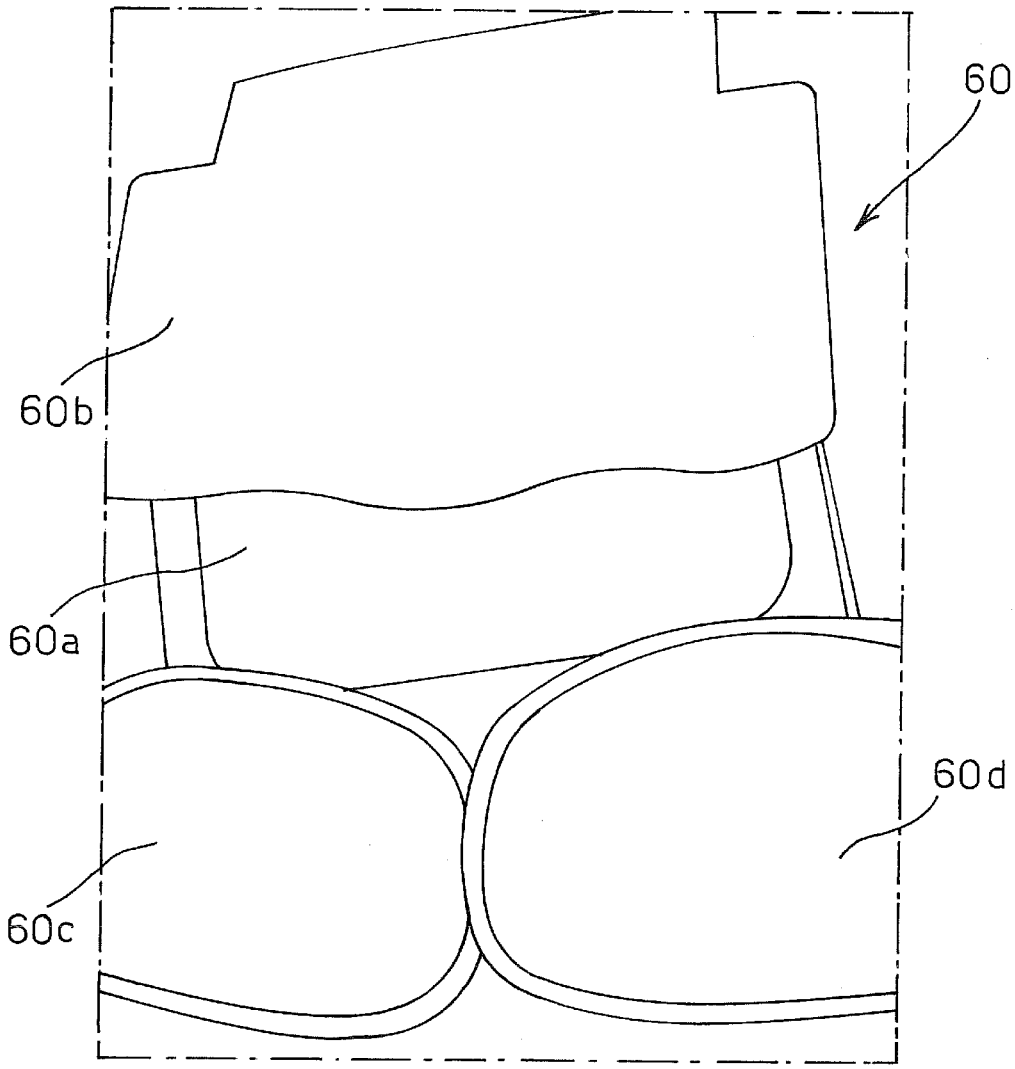
FIG. 4 shows the supporting structure in FIGS. 1*a*-1*d* provided with a padding system according to the invention.

FIG. 4 illustrates a configuration of the postural system according to the invention in which a padding system, generically indicated by reference 60, is applied to the supporting structure in FIGS. 1*a*-1*d*.

Said padding system 60 is in turn of a modular structure (a so-called "Forme Libere" structure) and comprises a plurality of padded cushions 60*a*-60*d* of a type, shape and thickness which may be the same or different, suitably combined according to the load which each body segment has to support and the stresses to which it is subjected during use.

In particular modular padding system 60 comprises separate sub-systems, of which:

- a first sub-system pads said modular base 20 and said modular system 30 to accommodate the legs associated therewith and for this purpose comprises a pair of suitably shaped pads, each comprising one or more overlapping padded cushions;
- a second system is suitable for padding modular system 40 for accommodating the pelvis and for this purpose comprises one or more suitably shaped pads, each comprising one or more overlapping padded cushions.

Each padded cushion 60*a*-60*d* may be made using different types and combinations of high-performance polymer foam, cross-linked foam to encourage ventilation, visco-elastic foam with a slow memory return and the like, or even using alternative materials to polymer foam that are nevertheless suitable for the present application.

Padded cushions 60*a*-60*d* may be joined together by means of water-based adhesives which do not adversely affect the characteristics and properties of the foam used or may also not be joined together, but simply juxtaposed. In fact the particular design of cut and choice of thicknesses makes it possible to adapt the padding system perfectly to the shape of the underlying supporting structure through the mere effect of body pressure exerted by the user during use.

The supporting structure of the postural system padded in this way is covered with a lining which permits accommodation to the postural configuration found.

Figure 5:
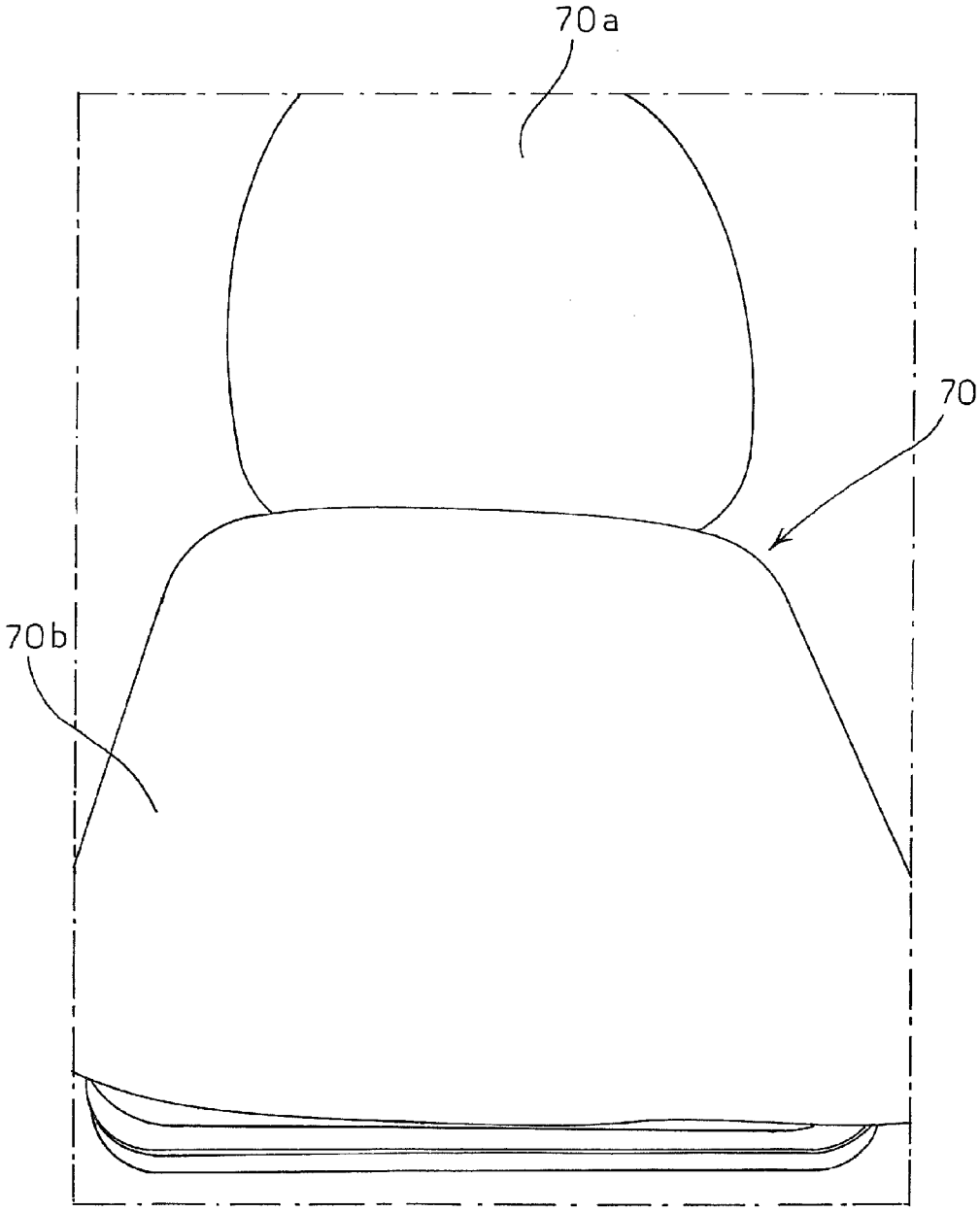
FIG. 5 shows the supporting structure in FIG. 3 provided with a padding system according to the invention.

Similarly FIG. 5 illustrates a configuration of the postural system according to the invention in which a padding system, generically indicated by reference 70, is applied to the supporting structure in FIG. 3.

Said padding system 70 in turn has a modular structure and comprises a plurality of sub-systems 70*a*-70*b*, each comprising padded cushions of the same or different type, shape and thickness, suitably combined according to the load which each body segment has to support and the stresses imposed upon it during use.

In particular a first sub-system 70*a* corresponding to the back of the postural system and a second sub-system 70*b* corresponding to the supporting structure thereof may be seen in FIG. 5.

Said first sub-system 70*a* together with the underlying plurality of modular blocks 50*a*-50*e* for accommodation of the user's spine and a corresponding form of lining constitutes a kit (a so-called "Forme Accolte" kit).

Here again the supporting structure of the postural system padded in this way is covered with a lining cover which enables it to adjust to the postural configuration found.

Figure 6:
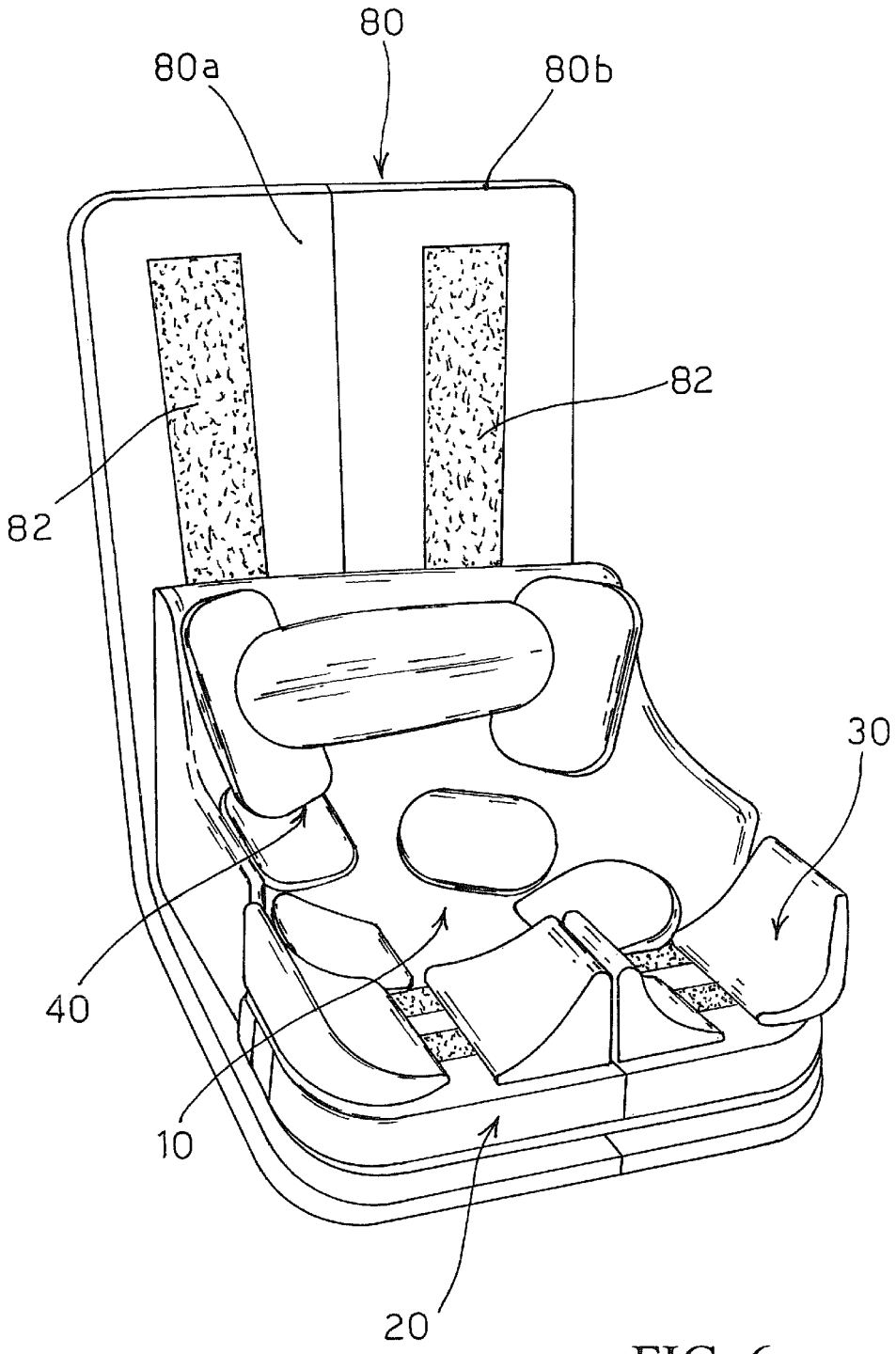
FIG. 6 shows a further configuration of the modular construction of the supporting structure of the postural system according to a third embodiment of the invention.

The supporting structure of the postural system according to the invention may be provided with a great variety of accessories used individually or in combination according the user's specific requirements. By way of example FIG. 6 illustrates a third embodiment of the postural system according to the invention which comprises a modular system, generically indicated by reference 80, for accommodating the user's shoulders and head.

Said modular system 80 comprises modular blocks 80*a*-80*b* made of plastics or composite material, pre-shaped and adjustable through cutting, removal of material or other similar processing.

Each of modular blocks 80*a*-80*b* may be provided with coupling means 82 along the top and bottom surface to permit coupling to the supporting structure of the postural system.

Said coupling means 82 may for example comprise coupling systems using binder blocking systems and/or male and/or female fastener tapes. Said modular system 80 positioned posteriorly to the supporting structure of the postural system makes it possible to provide complete postural support for the user and allow stable supporting positioning along the backs of different sitting and/or transfer devices such as seats, buggies, high chairs for medical or domestic use and so on.

In general, in accordance with the invention, it will be possible to provide a kit comprising the said base plate 10, one or more pluralities of the said modular blocks 20*a*-20*f*, 30*a*-30*d*, 40*a*-40*f*, 50*a*-50*e*, 80*a*-80*b*, and one or more pluralities of the said padded cushions 60*a*-60*d*, 70*a*-70*b*, so that the postural system can be constructed by suitably associating the said modular blocks and the said padded cushions to the said base plate according to the user's requirements, selecting the number, shape, size and orientation of the said blocks and said cushions according to the patient's structural shape.

It is obvious from what has been described above that the postural system according to the invention makes it possible to accomplish the objects specified above in that it makes it possible to allow for the user's specific shape in order to encourage perfect accommodation of the body and proper weight distribution and also makes it possible to adjust its structure to changes in the said shape which may occur in the course of use.

It is also obvious that the embodiments described above have been provided purely by way of example and that many modifications and variants are possible without departing from the scope of protection of the invention as defined by the appended claims.

The invention claimed is:

1. A postural system, comprising:

a flat base plate;

a plurality of modular blocks, different in shape and size, suitable for being coupled to said base plate in order to obtain a supporting structure shaped so as to fit the morphological structure of a user of the postural system;

said base plate being provided with coupling means for removable and reversible coupling with an external supporting surface and with said modular blocks, and said modular blocks being provided with means for removable and reversible coupling with said base plate and with one another;

said modular blocks comprising:

a first plurality of modular blocks configured to provide a modular base;

a second plurality of modular blocks configured to provide a modular system for accommodating the legs of said user; and a third plurality of modular blocks configured to provide a modular system for accommodating the pelvis of said user, said third plurality of modular blocks comprising a pair of coccyx inserts positioned over the base plate at a rear of the base plate, each insert having an inclined shape;

wherein said first plurality of modular blocks, second plurality of modular blocks and third plurality of modular blocks are respectively shaped and arranged relative to one another so as to achieve containment, suspension and anterior, lateral and posterior control of the pelvis of the user, as well as containment, suspension and control of the coccyx, sacral vertebrae, lumbar vertebrae and thoracic vertebrae of the user.

2. The postural system according to claim 1, wherein a top surface of said base plate is provided with coupling means for removable and reversible coupling with said first plurality of modular blocks and wherein respective bottom surfaces of said modular blocks are provided with corresponding coupling means for removable and reversible coupling with said base plate.

3. The system according to claim 1, wherein top surfaces of said first modular blocks are provided with coupling means for removable and reversible coupling with said second plurality of modular blocks and wherein respective bottom surfaces of said second modular blocks are provided with corresponding coupling means for removable and reversible coupling with said modular base.

4. The postural system according to claim 1, wherein said second plurality of modular blocks comprises two or more separate and independent modular blocks for building up the central abductor assembly.

5. The postural system according to claim 1, wherein a top surface of said base plate is provided with coupling means for removable and reversible coupling with said third plurality of modular blocks and wherein at least one of respective bottom and top surfaces of said third modular blocks are provided with corresponding coupling means for removable and reversible coupling with said base plate.

6. The postural system according to claim 1, comprising a fourth plurality of modular blocks and a flat base back coupled thereto, suitable for obtaining a modular system for accommodating the spine of said user.

7. The postural system according to claim 6, wherein a top surfaces of said third modular blocks are provided with coupling means for removable and reversible coupling with said fourth plurality of modular blocks and wherein respective bottom surfaces of said fourth modular blocks are provided with corresponding coupling means for removable and reversible coupling with said modular system for accommodating the pelvis of said user.

8. The postural system according to claim 1, wherein a padding system is applied on said supporting structure, said padding system also having a modular structure and comprising a plurality of padded cushions, having different structure, shape and size and suitable for being combined.

9. The postural system according to claim 1, wherein said system is fitted on or is an integral part of medical support devices for at least one of mobility and medical devices for rehabilitation and social or domestic life.

10. The postural system according to claim 1, wherein said system is fitted on or is an integral part of chairs, seats, benches.

11. The postural system according to claim 1, wherein said system is fitted on or is an integral part of transport means.

12. The postural system according to claim 9, wherein said system is fitted on or is an integral part of medical support devices for for non-ambulant or partly-ambulant persons.

13. The postural system according to claim 10, wherein said system is fitted on support structures for persons who are able to walk properly.

14. A postural system, comprising:

a flat base plate;

a plurality of modular blocks, different in shape and size, suitable for being coupled to said base plate in order to obtain a supporting structure shaped so as to fit the morphological structure of a user of the postural system, said base plate comprising a fastening mechanism that removably and reversibly couples with an external supporting surface and with said modular blocks, and said modular blocks comprising a fastening mechanism that removably and reversibly couples with said base plate and with one another;

said modular blocks comprising:

a first plurality of modular blocks configured to provide a modular base;

a second plurality of modular blocks configured to provide a modular system for accommodating the legs of said user; and a third plurality of modular blocks configured to provide a modular system for accommodating the pelvis of said user, said third plurality of modular blocks comprising a pair of coccyx inserts positioned over the base plate at a rear of the base plate, each insert having an inclined shape;

wherein said first plurality of modular blocks, second plurality of modular blocks and third plurality of modular blocks are respectively shaped and arranged relative to one another so as to achieve containment, suspension and anterior, lateral and posterior control of the pelvis of the user, as well as containment, suspension and control of the coccyx, sacral vertebrae, lumbar vertebrae and thoracic vertebrae of the user.

15. The postural system according to claim 14, wherein said fastener mechanism comprises a binder blocking system or fastener tapes.

16. The postural system according to claim 14, wherein the second plurality of modular blocks comprises an abductor block system with opposing curved inclined surfaces positioned over the base plate at a front center of the base plate corresponding to an inside of right and left legs of the user, respectively, and a pair of curved inclined outside leg support inserts positioned over the base plate at respective right and left front sides of the base plate corresponding to an outside of the right and left legs of the user, respectively, the second plurality of modular blocks thereby providing support for the right and left legs.

17. The postural system according to claim 16, wherein the abductor block system comprises a pair of blocks, each having a curve inclined surface.

18. The postural system according to claim 14, further comprising a back member and a fourth plurality of modular blocks removably coupled to the back member, the fourth plurality of modular blocks comprising a pair of inclined curved inserts positioned on the back member at respective right and left sides of the back member to support the user's spine; and wherein the pair of coccyx inserts are not supported by the back member.

* * * * *